US008083010B2

(12) United States Patent
Hulkkonen et al.

(10) Patent No.: US 8,083,010 B2
(45) Date of Patent: Dec. 27, 2011

(54) DRILLING DEVICE FOR DRILLING AND REAMING OF A HOLE

(76) Inventors: Teijo Hulkkonen, Tampere (FI); Hannu Paasonen, Nokia (FI)

( * ) Notice: Subject to any disclaimer, the term of this patent is extended or adjusted under 35 U.S.C. 154(b) by 0 days.

(21) Appl. No.: 12/438,429

(22) PCT Filed: Aug. 23, 2007

(86) PCT No.: PCT/FI2007/000208

§ 371 (c)(1),
(2), (4) Date: Feb. 23, 2009

(87) PCT Pub. No.: WO2008/023089

PCT Pub. Date: Feb. 28, 2008

(65) Prior Publication Data

US 2009/0188722 A1 Jul. 30, 2009

(30) Foreign Application Priority Data

Aug. 23, 2006 (FI) ..... 20060749

(51) Int. Cl.

| | |
|---|---|
| ***E21B 7/30*** | (2006.01) |
| ***E21B 10/40*** | (2006.01) |
| ***E21B 4/06*** | (2006.01) |
| ***E21B 10/32*** | (2006.01) |

(52) U.S. Cl. ..... 175/273; 175/19; 175/96; 175/279; 175/293; 175/415

(58) Field of Classification Search ..... 175/263, 175/265, 279, 273, 293, 414, 384, 292, 19, 175/95, 96, 415

See application file for complete search history.

(56) References Cited

U.S. PATENT DOCUMENTS

| | | | | | |
|---|---|---|---|---|---|
| 1,612,338 | A | * | 12/1926 | Wilson et al. | 173/15 |
| 3,161,243 | A | * | 12/1964 | Davis | 175/95 |
| 3,773,121 | A | * | 11/1973 | Ikeda | 175/95 |
| 3,837,413 | A | | 9/1974 | Dunn | |
| 5,125,768 | A | | 6/1992 | Ilomaeki | |
| 5,787,999 | A | * | 8/1998 | Holte | 175/273 |

FOREIGN PATENT DOCUMENTS

| | | | | |
|---|---|---|---|---|
| FI | 20040586 | | | 11/2005 |
| FR | 1407698 | | | 6/1965 |
| GB | 2132252 | A | * | 7/1984 |
| JP | 2002155692 | A | * | 5/2002 |
| WO | WO 9201856 | | | 2/1992 |

* cited by examiner

*Primary Examiner* — Kenneth L Thompson

(74) *Attorney, Agent, or Firm* — Stites & Harbison PLLC; Douglas E. Jackson

(57) ABSTRACT

A drilling device used for drilling into ground, rock or for reaming a predrilled hole includes several hammering bits in a circular shape and equipped with hammers, whereupon they together drill a hole which has a larger diameter. A casing tube can be pulled out of the hole/pushed into the drilled hole. A tubular, rotatable drill rod tube resides in the casing tube. The hammers are located in a circular shape and are each attached to the outer surface of the drill rod tube by joint/hinge attachments lying essentially in the drilling direction. Rotation of the drill rod tube in a first direction turns the hammers and associated bits outwardly from the drill rod tube, and rotation in another direction turns the hammers with their bits inwardly towards the drill rod tube so that they can be pulled away with the drill rod tube from inside the casing tube.

8 Claims, 2 Drawing Sheets

DRILLING DEVICE FOR DRILLING AND REAMING OF A HOLE

The invention relates to a drilling machine for drilling a hole into the ground, rock or for reaming a pre-drilled hole which drilling device comprises, if required, a bit which drills the central part of the hole and a hammer for it or the mentioned bit is at least partly replaced with an end piece which takes control of the pre-drilled hole whereupon in both cases the drilling device additionally comprises several hammering bits placed in a circular shape and equipped with its own hammer whereupon they drill together a bigger hole which has a larger diameter. The drilling device involves a casing tube which can be pulled out of the hole/pushed into the hole which is formed during drilling. Also essentially in the middle of the drilling device exists a tubular, rotatable drill rod tube.

From the patent publication FI-85302 a drilling device, which has several hammering bits some of which have been placed to drill a hole which has a larger diameter, is already known. Each bit has its own hammer which is detachable. During drilling the casing tube is placed into a ready-made hole when drilling progresses. There are only hammers as a solution and with them bits which are detachable and removable from the hole. Instead, other drilling devices cannot be removed until horizontal drilling has been completed and the drill has come back into the sight and created a tunnel. With the drilling device drilling can be done without a pilot hole and a direction given by it.

Further a drilling device is known from the patent application 20040586 that has bits that drill the outer edge of the hole located in a circular shape and all have their own hammer. Hammers are rotatable in such a way that bits protrude outwards from the centre of the device to a drilling position and accordingly are rotatable into a closed position whereupon drilling equipment can be pulled away from the casing tube. With this solution neither vertical holes nor ending horizontal holes can be drilled into the ground in a realiable way so that the resulting hole could easily be released from the drilling devices when only the casing tube remains in the hole. The attachment of the rotatable drilling devices relies only on one hinge point and thus cannot take hammerings very well and drilling devices turn from the strength of drilling hammerings. Turning drilling devices must also be directed diagonally in relation to the drilling direction during drilling whereupon the location of the attachment point moves even further to the drilling device from a moment producing load line. An essential improvement can be achieved in this situation with the new drilling device according to the invention and characteristic for the invention is the fact that hammers which are placed in a circular shape are each attached to the outer surface of the drill rod tube with the help of hinge attachments essentially in the drilling direction and rotation of the drill rod tube in a first direction turns the drilling devices in the mentioned hinge attachment of the hammers from the drill rod tube to go separate to its side and rotation in another direction turns hammers with their bits towards the drill rod tube so that they can be pulled away from the casing tube with the drill rod tube.

The advantage of the invention is the fact that drilling of the vertical holes, which have a large diameter D over 1 m, is possible in such a way that the casing tube is left in the hole and the drilling devices are pulled up from the hole. Turning of the drilling devices, which drill the outer circle of the hole towards the drill rod tube during upward pulling happens automatically. Correspondingly the mentioned drilling devices stay automatically in the right position when disengaged from the drill rod tube during drilling. The drilling device can also be applied to drilling of diagonal and horizontal holes.

In the following the invention can be explained more detailed by referring to the accompanying drawing in which FIG. 1 shows a partial section view from side of one drilling device according to the invention.

Figure 1:
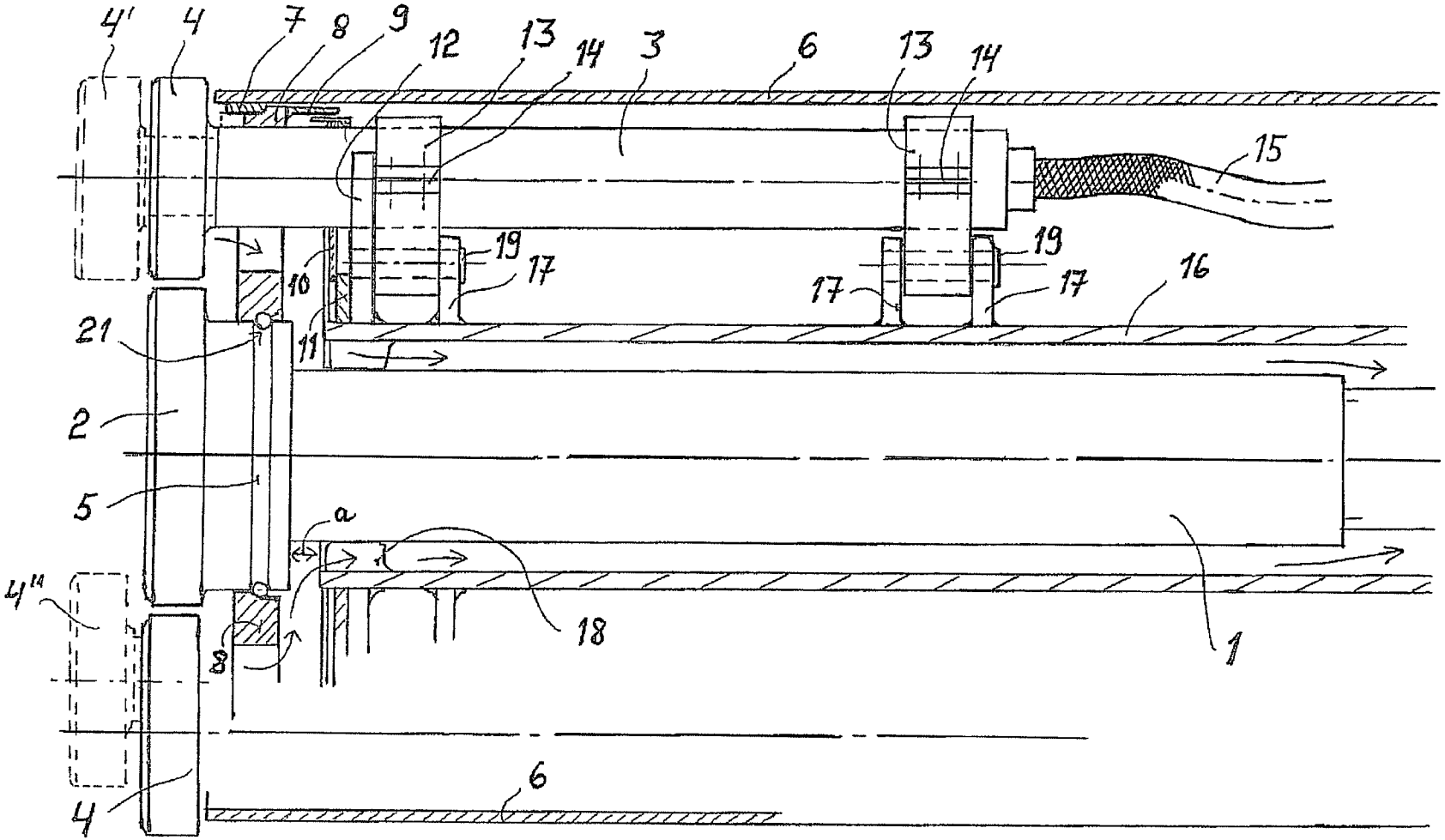

The drilling device in FIG. 1 has a tubular drill rod 16 which is rotated and possibly also pushed from the surface of the ground. Extension tubes can be added when drilling progresses. This drill rod tube 16 functions also as a drill waste outlet pipe. A drilling device, which drills the central part of the hole, is arranged into the drill rod tube 16, of which hammer 1 and the bit 2 have been presented. The hammer 1 is rotated and possibly also pushed from the surface of the ground. If vertical holes are being drilled, then pushing of the drilling device 1 and of the drill rod tube 16 can be removed. Sometimes they may even have to supported. The hammer 1 has been positioned in the centre of the drill rod tube 16 with the help of centering devices 18, which have been arranged to the circle of the hammer 1 so that flushing air can be removed backwards in between of them. The flange 8 starts from the bit 2 towards the casing tube 6 so that the flange 8 delivers hammerings which are coming to the bit 2 and to the casing tube 6 via the shouldered arrangement 21 of the bit 2 and further via the shouldered arrangement of the flange 8 and via the tyre 7 attached to the casing tube. There is also a lap joint arrangement 9 at the outer edge of the flange 8 which limits access of flushing air into the casing tube 6 next to it.

Two joint tap attachments 17, 19 have been attached to the outer surface of the drill rod tube 16 by using drilling machines 3 which drill the outer circle of the hole and which all comprise a hammer placed in the drilling device 3 and a bit 4 attached to its head. The drilling devices 3 are mounted to the joint taps 19 with the help of a collar part 13, 14 which can be divided. Joint tap attachments 17, 19 allow the drilling devices 3 to turn essentially in a drilling direction while moving towards the drill rod tube 16 and away from it. The drilling devices 3 are in the drilling position in FIG. 1 that is detached from the drill rod tube 16. The drilling devices 3 in the case of the FIG. 1 have no space to turn towards the drill rod tube 16 for the extraction of the devices unless bits 4 of the drilling devices 3 move to a different drilling stage in relation to the bit 2. Bits 4 move to a different level when during extraction the pull is performed via the central drilling device 1, whereupon its bit 2 can move to a pulling direction when the distance and other equipment still stay immovable. The shouldered arrangement between the bit 4 and the flange 8 and the tyre 21 allow this to happen. In addition, during extraction the bits 4 touch the head of the casing tube 6 and bits 4 move outwards when the collar part of them comes out from inside the hammer to the position 4'. Turning of drilling devices 3 towards the drill rod tube 16 is possible after this to the position 4". When drilling devices 3 and their bits are in position 4", all the devices can be pulled away from the casing tube.

Figure 2:
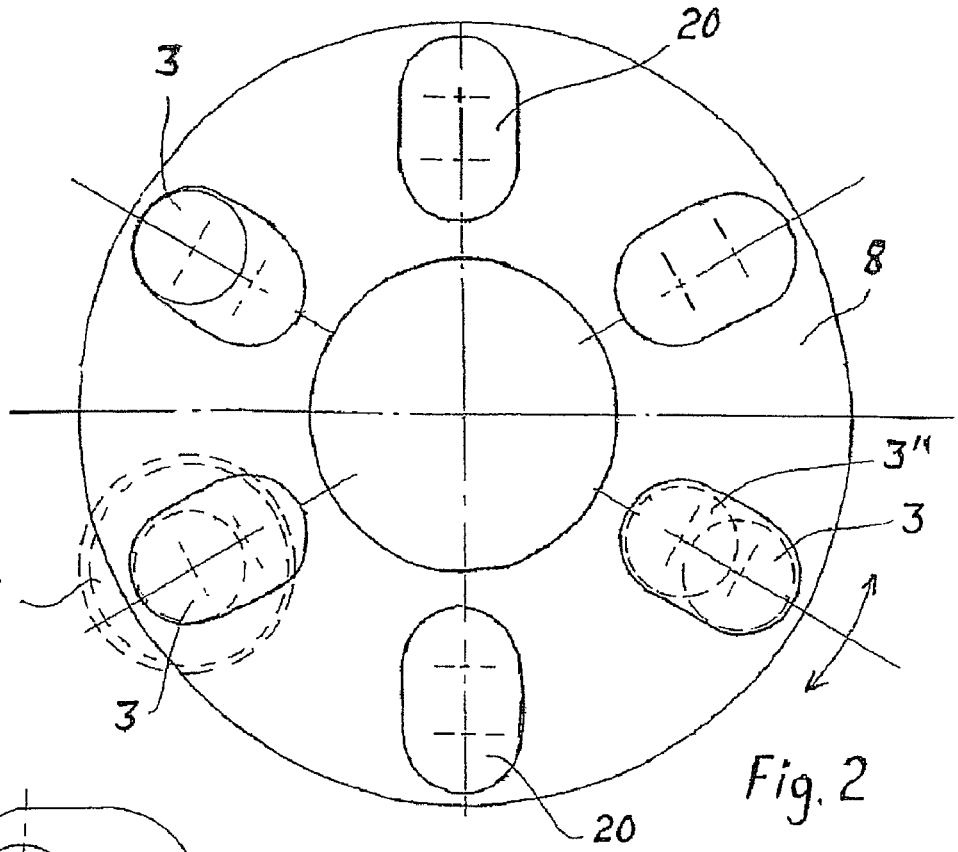
FIG. 2 shows a flange of the drilling device which delivers hammerings from the pilot bit to the casing tube in order to make the casing tube go further during drilling.

FIG. 2 shows a flange 8 which delivers hammerings from the bit 2 to the casing tube 6. The flange 8 has holes 20 which allow the drilling devices 3 to turn when the drilling devices 3 are in the holes 20. When drilling devices 3 perform the turning movements from position 3 to position 3", and back, the flange 8 must rotate a little in relation to the drill rod tube 16.

Figure 3:
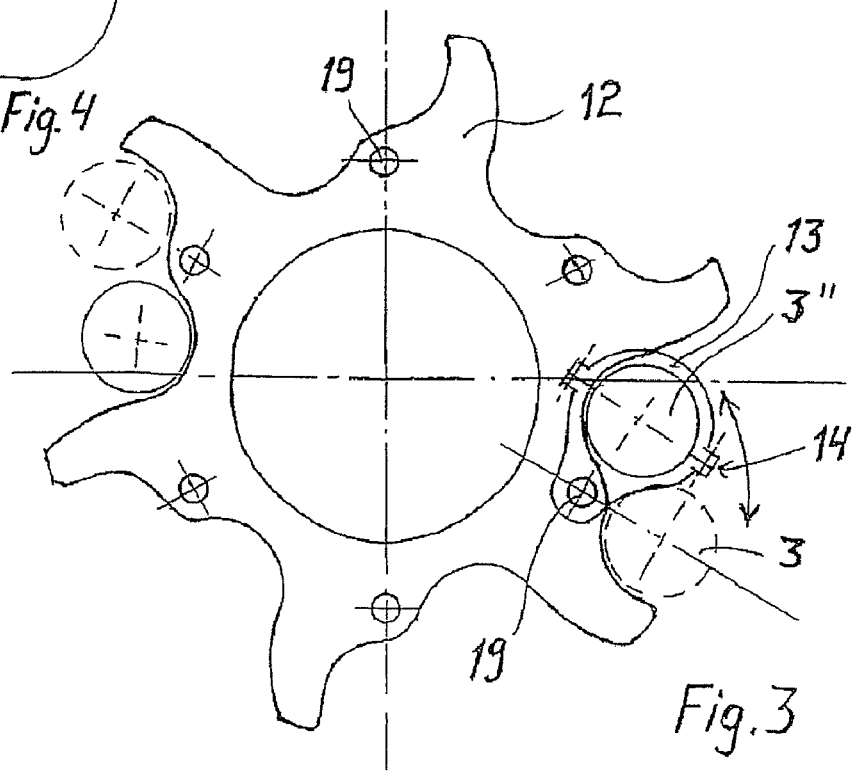
FIG. 3 shows a flange which passes rotating movement from the drill rod tube to drilling equipment which drill the outer circle of the hole.

The flange 12 which can be attached fixed to the drill rod tube 16 is presented in the FIG. 3. The flange controls turning of drilling devices 3 and delivers a rotation movement to them as a result of which they rotate at the outer circle of the hole. The rotation of the flange 12 clockwise in FIG. 3 turns the drilling devices 3 around the joint points 19 so that they come closer to the drill rod tube 16 for the extraction. The rotation of the flange 12 counter clockwise turns the drilling devices into the drilling position outwards in the circle. Stations for the drilling devices 3 in the flange 12 have been arranged for both purposes.

When drilling is finished, equipment is rotated with the help of the drill rod tube 16 against the drilling direction at the same time when it is being pulled away.

Figure 4:
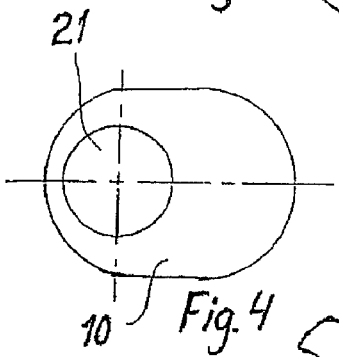
FIG. 4 shows a casing flange which is meant for controlling flushing flow.

The casing flange 10, which has a gap 21 arranged for the drilling device 3, is presented in the FIG. 4. The casing flange 10 is placed to cover the gaps of the flange 11 which is in the front of the flange 12 regarding each drilling device 3. The flange 11 has gaps, like the flange 8 has and flushing detergent might leak from the gaps of the flange 11 backwards during drilling unless the casing flanges 10 were not at the neck of each drilling device 3, not moving with them and or not covering the hole of the flange 11.

The purpose of the flushing detergent is to transport drilling waste from the drilling surface to behind the drill rod tube 16 according to the arrows. The flushing air is brought separately to each drilling device 3 via the tubes 15.

In FIG. 1 there is a drilling device which is meant to drill a hole without a pre-drilled pilot hole. If a pre-drilled pilot hole exists, the bit 2 can just be a directing head from its central part which is positioned in the pre-drilled hole. The outer edges of the bit 2 can for example be the already drilling bit areas.

The invention claimed is:

1. Drilling device for drilling a hole into ground or rock or for reaming a predrilled hole, which drilling device comprises:

several outer hammering bits placed in a circular shape about a central axis, each said outer hammering bit being equipped with a respective longitudinal hammer drill machine, whereby in use the outer hammering bits together drill an outer circumferential portion of a hole;

a casing tube which is pulled out of and pushed into the drilled hole created during drilling with the outer hammering bits, said casing tube being essentially located about the central axis;

a tubular, rotatable drill rod tube located centrally of the casing tube, wherein the longitudinal hammer drill machines are placed in a circular shape, and the longitudinal hammer drill machines are each attached to an outer surface of the drill rod tube via at least one joint/hinge attachment essentially in a drilling direction, and wherein a rotation of the drill rod tube a) in a first direction hingeingly rotates the hammer drill machines and associated outer hammering bits, via the joint/hinge attachments of the respective hammer drill machines, outwardly from the drill rod tube towards the casing tube to an outward position to drill the outer circumferential portion of the hole, and b) in an opposite, second direction hingeingly rotates the hammer drill machines and associated outer hammering bits, via the joint/hinge attachments of the respective hammer drill machines, inwardly towards the drill rod tube to an inward position so that the hammers and associated bits are able to be pulled away with the drill rod tube from inside of the casing tube, and further including a rotating flange which rotates with the drill rod tube, said rotating flange being arranged to turn all of the hammer drilling machines simultaneously as desired outwardly from or inwardly towards the drill rod tube.

2. Drilling device according to claim 1, further including a central drill bit located between said hammering bits, and a moving means for moving the hammering bit of each hammer drilling machine into a longitudinally extended position away from the respective hammer drilling machine and in front of the central bit so that movement of the hammering bits towards the drill rod tube is not impeded by the central bit.

3. Drilling device according to claim 1, wherein the flange is also arranged to rotate the hammer drilling machines around the drill rod tube during drilling.

4. Drilling device according to claim 1, further including a central bit placed along the central axis, which central bit comprises a flange arranged to deliver hammerings from the central bit to the casing tube in order to advance the casing tube.

5. Drilling device according to claim 4, wherein the flange is equipped with large holes through which the hammer drilling machines extend and through which flushing air is directed from a drilling surface to behind the drill rod tube.

6. Drilling device according to claim 1, wherein the hammer drilling machines are attached to the outer surface of the drill rod tube with at least two suitable joint/hinge tap attachments which are placed at a distance from each other.

7. Drilling device according to claim 1, further including a central bit, and wherein the hammering bits are arranged at a different longitudinal level with the central bit, whereupon the hammering bits are rotatable partly overlapped with the central bit when the hammer drilling machines are being pulled away from inside of the casing tube.

8. Drilling device for drilling a hole into ground or rock or for reaming a predrilled hole, which drilling device comprises:

several outer hammering bits placed in a circular shape about a central axis, each said outer hammering bit being equipped with a respective longitudinal hammer drill machine, whereby in use the outer hammering bits together drill an outer circumferential portion of a hole;

a casing tube which is pulled out of and pushed into the drilled hole created during drilling with the outer hammering bits, said casing tube being essentially located about the central axis;

a tubular, rotatable drill rod tube located centrally of the casing tube, wherein the longitudinal hammer drill machines are placed in a circular shape, and the longitudinal hammer drill machines are each attached to an outer surface of the drill rod tube via at least one joint/hinge attachment essentially in a drilling direction, and wherein a rotation of the drill rod tube a) in a first direction hingeingly rotates the hammer drill machines and associated outer hammering bits, via the joint/hinge attachments of the respective hammer drill machines, outwardly from the drill rod tube towards the casing tube to an outward position to drill the outer circumferential portion of the hole, and b) in an opposite, second direction hingeingly rotates the hammer drill machines and associated outer hammering bits, via the joint/hinge attachments of the respective hammer drill machines, inwardly towards the drill rod tube to an inward position so that the hammers and associated bits are able to be pulled away with the drill rod tube from inside of the casing tube, and further including a central bit placed along the central axis, which central bit comprises a flange arranged to deliver hammerings from the central bit to the casing tube in order to advance the casing tube.

* * * * *